United States Patent [19]

Borel

[11] Patent Number: 4,815,503

[45] Date of Patent: Mar. 28, 1989

[54] FABRIC FOR THE SHEET FORMING SECTION OF A PAPERMAKING MACHINE

[75] Inventor: Georg Borel, Reutlingen, Fed. Rep. of Germany

[73] Assignee: Hermann Wangner GmbH & Co. KG, Fed. Rep. of Germany

[21] Appl. No.: 104,903

[22] Filed: Oct. 6, 1987

[30] Foreign Application Priority Data

Oct. 10, 1986 [DE] Fed. Rep. of Germany ..... 3634649

[51] Int. Cl.[4] ..... D03D 15/00

[52] U.S. Cl. ..... 139/383 A; 162/DIG. 1

[58] Field of Search ..... 139/383 A, 425 R; 162/DIG. 1; 428/257

[56] References Cited

U.S. PATENT DOCUMENTS 4,119,753 10/1978 Smart ..... 139/383 A
4,423,755 1/1984 Thompson ..... 139/383 A
4,499,927 2/1985 Borel ..... 139/383 A
4,564,052 1/1986 Borel ..... 139/383 A
4,592,396 6/1986 Borel et al. ..... 139/383 A

*Primary Examiner*—Henry S. Jaudon
*Attorney, Agent, or Firm*—Sughrue, Mion, Zinn, Macpeak & Seas

[57] ABSTRACT

A fabric for the sheet forming section of a papermaking machine includes a double-layer or multi-layer fabric of interwoven longitudinal and transverse threads and additional transverse threads floating on the paper side. The additional transverse threads have a greater repeat length than the ordinary transverse threads and alternatingly float in one weave repeat on the paper side, while in the next weave repeat they are interwoven in the fabric interior. The additional transverse threads preferably have a smaller diameter than the ordinary transverse threads.

4 Claims, 3 Drawing Sheets

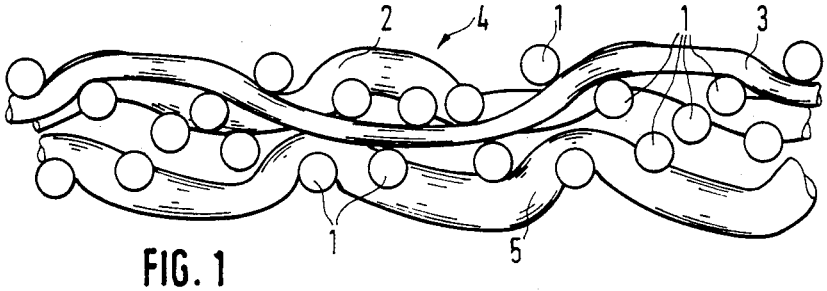
FIG. 1
FIG. 2
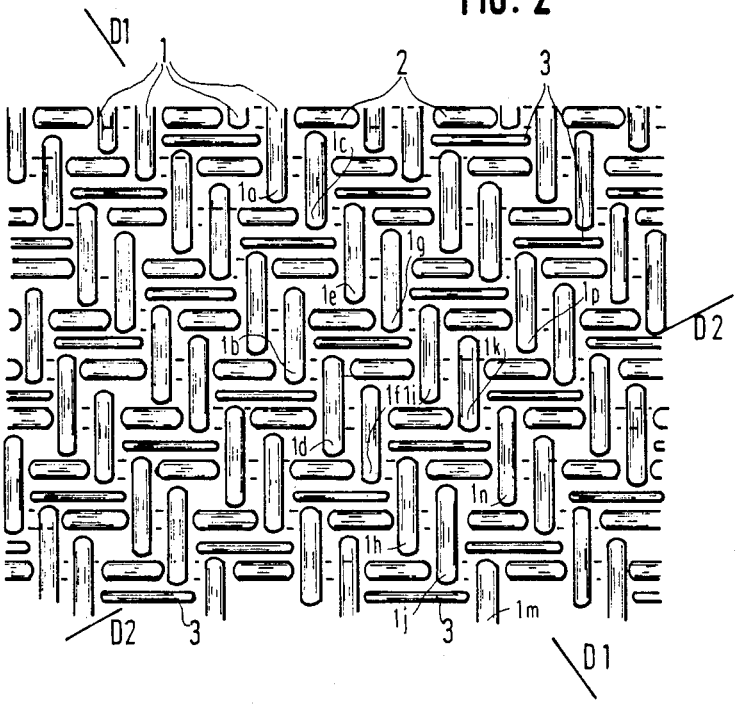

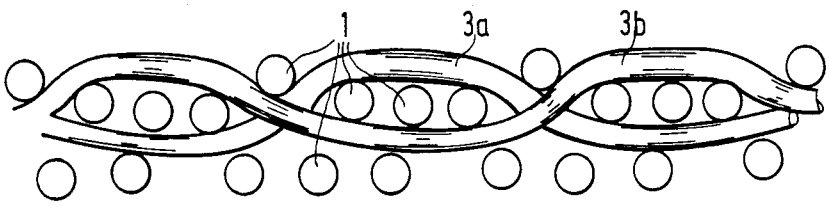
FIG. 3
FIG. 4
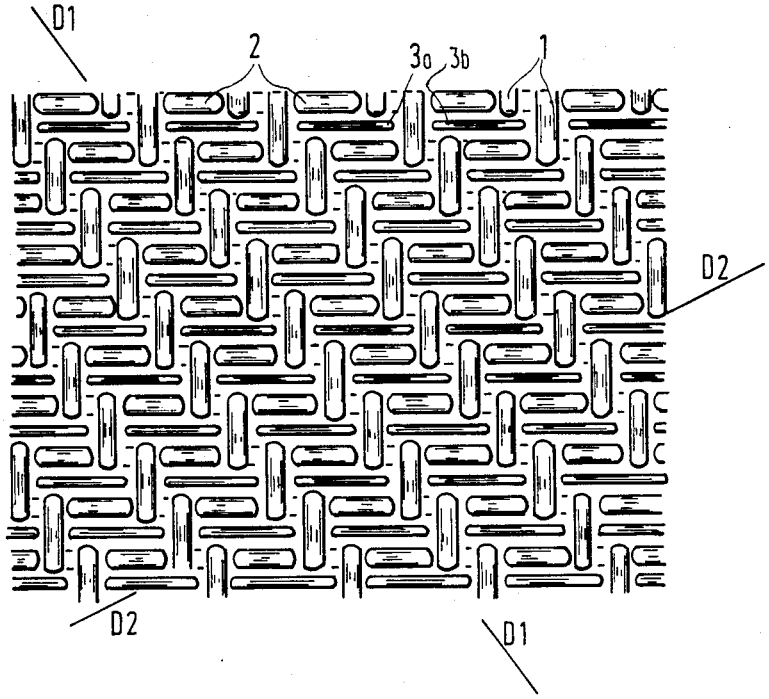

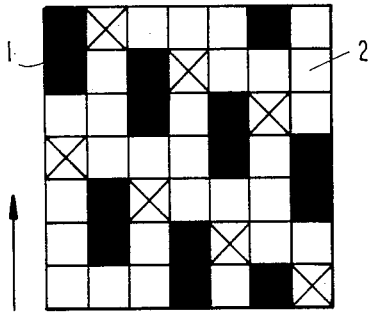
FIG. 5
FIG. 6
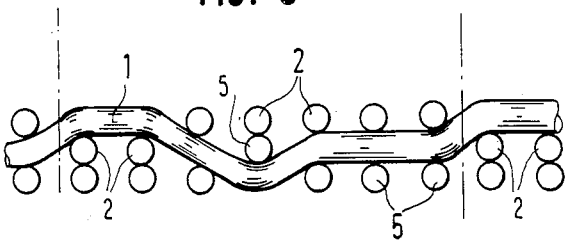

FABRIC FOR THE SHEET FORMING SECTION OF A PAPERMAKING MACHINE

BACKGROUND OF THE INVENTION

The invention relates to a fabric for the sheet forming section of a papermaking machine comprising a double-layer or multi-layer fabric of interwoven longitudinal and transverse threads and additional transverse threads floating on the paper side.

Papermachine fabrics with additional transverse threads floating on the paper side have been known from U.S. Pat. Nos. 4,182,381 and 4,281,688 and from European Patent Publication No. 85 363. According to U.S. Pat. No. 4,182,381, the additional transverse threads are to reduce wear especially in the region of a loop seam. According U.S. Pat. No. 4,281,688, the transverse threads are so interwoven that equally long floats are formed on the paper side and on the running side, which is to prevent curling of the edges.

According to European Patent Publication 85 363, the additional transverse threads floating on the paper side are to facilitate the removal of the sheet, reduce the risk of marking, and increase the permeability. The additional transverse threads are so interwoven that they have minimum crimp. However, as a consequence, they project on the paper side so far that they interfere with the sheet formation. During cleansing of the fabric by high pressure water jets, projecting threads are frequently destroyed.

German Ausleggesschieft No. 32 24 236 and European Patent Publications Nos. 69 101, 93 096, and 117 856 disclose sheet forming fabrics in which longitudinal threads or transverse threads are interwoven in pairs, and the threads of each pair are mutually offset, but otherwise interwoven in the same way, so that on the paper side a regular weave pattern is formed. In case the pair-wise interwoven threads are provided in addition to ordinary interwoven threads, they supplement each other on the paper side in forming the same weave as the ordinary threads. The pair-wise interwoven threads have the purpose of joining two fabric layers, or two layers of transverse threads, to one another.

SUMMARY OF THE INVENTION

The present invention provides a fabric of the initially described type for the sheet forming section of a paper machine in which the risk of destruction of transverse threads during cleaning with high pressure water jets is reduced. This problem is solved since the additional transverse threads have a greater repeat length than the ordinary transverse threads and alternately float in one basic weave repeat on the paper side while in the next weave repeat they are not visible on the paper side.

Preferably, the additional transverse threads are interwoven pair-wise in opposition, i.e. in one basic weave repeat one additional transverse thread of a pair floats on the paper side Thus, defined fabric repeat is twice as long as the original basic weave repeat, while the other thread extends in the fabric interior, and in the next weave repeat the course is reversed, i.e. the other thread floats on the paper side, while the one basic fabric thread extends in the fabric interior. Preferably the additional floating transverse threads consist of especially soft, readily extensive material and have a smaller diameter than the ordinary transverse threads.

The fabric can be woven flat or endless. The fabric is made endless by a woven seam if it is woven flat. As usual, the threads consist of synthetic resin monofilaments. In general, a material with a higher elastic modulus is selected for the longitudinal threads than for the transverse threads. Especially in endless fabrics, however, the threads can also consist of synthetic resin multifilaments.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a sectional view of a fabric along an additional transverse thread;

FIG. 2 is a plan view of the fabric in FIG. 1, containing an additional transverse thread floating on the paper side in every second repeat of the basic fabric weave;

FIG. 3 is a sectional view of a modified fabric along an additional transverse thread;

FIG. 4 is a plan view of the fabric in FIG. 3, in which the additional transverse threads are interwoven pair-wise in opposition;

FIG. 5 is a diagram showing the weave pattern of the basic fabric (without additional transverse threads) of Example 1, in which the arrow indicates the running direction of the warp or longitudinal threads, the black areas indicate that the warp is visible on the paper side, while at the remaining crossing points on the paper side, the weft or transverse threads are visible, and the cross in several of the areas indicates that the warp is visible on the running side, i.e. that it extends under a pair of weft threads, and FIG. 6 shows the course of the longitudinal thread in Example 1, while the additional transverse threads have been omitted.

DETAILED DESCRIPTION OF THE INVENTION

FIG. 1 shows in cross section a double-layer seven-harness fabric. The double-layer fabric, in this context, means a fabric comprising two layers of transverse threads interwoven with a single system of longitudinal threads. The upper side or paper side of the fabric is formed by interwoven longitudinal threads 1 and upper transverse threads 2. To each upper transverse thread 2, a lower transverse thread 5 is coordinated so that the transverse threads are arranged in pairs. The longitudinal threads 1 are also interwoven with the lower transverse threads 5. The lower transverse threads 5 have very long downwardly projecting floats which form the running side of the papermachine fabric. Since the lower transverse threads 5 are especially exposed to wear, they suitably have a greater diameter than the upper transverse threads 2 and partially consist of especially wear-resistant material, e.g. polyamide and polyester.

The fabric contains additional transverse threads 3 which are alternately interwoven with the ordinary transverse threads 2 of the upper layer. The additional transverse threads 3 deviate in the weave pattern from the ordinary transverse threads 2 of the upper layer and have a greater repeat length, i.e. the pattern of interweaving repeats at greater intervals than that of the ordinary transverse threads 2. In the example of FIGS. 1 and 2, the additional transverse threads 3 have twice the repeat length as the upper transverse threads 2, i.e.

the basic fabric. The additional transverse threads 3 are so interwoven that they are visible on the paper side 4 in a weave repeat of the basic fabric formed by the longitudinal threads 1 and the transverse threads 2 and 5. They are monoplanar with the crimps of the upper transverse threads 2, and they contribute to the support of the forming sheet, while in the next repeat of the basic fabric, they extend in the fabric interior. Since they example illustrated by FIGS. 1 and 2 is a fourteen-harness fabric, this implies that the additional transverse threads 3 on the paper side float over six longitudinal threads 1 nd then extend in the fabric interior over a length spanning eight longitudinal threads 1.

The additional transverse threads 3 consist of relatively soft material of low elastic modulus, e.g. the same material as the upper transverse threads 2, but they have a smaller diameter. In the example of FIG. 1, the basic fabric is of a seven-harness weave, i.e. each basic fabric weave repeat contains seven longitudinal threads 1 and seven ordinary transverse threads 2 and 5 each of the upper and lower layer. In addition, each basic fabric weave repeat contains seven additional transverse threads 3. However, the weave repeat for the additional transverse yarn includes two basic weave repeats.

FIG. 2 shows in plan view the paper side of the fabric on which a particularly pronounced pattern diagonal D1 is discernible which extends from the upper left hand side to the lower right hand side. All the knuckles of the longitudinal threads 1, the ordinary upper transverse threads 2, and the additional transverse threads 3 are arranged along said pattern diagonal D1. The floats of the additional transverse threads 3 are offset so that not all are disposed in one pattern diagonal but are distributed over two adjacent diagonals. In FIG. 2, there consequently appears a coarse structure in a further pattern diagonal D2 extending from the upper right hand side to the lower left hand side. This diagonal weave D2 surprisingly does not mark the paper. On the contrary, there is less marking since the density of the transverse thread which floats along the first pattern diagonal D1 has been reduced. FIGS. 3 and 4 show an example in which the additional transverse threads 3 are interwoven in pair-wise opposite relationship. The weave of the basic fabric is the same as in the example of FIGS. 1 and 2, and FIG. 3 therefore only shows the interweaving of the additional transverse threads 3. One additional transverse thread 3*a* of the pair forms a weave repeat of fourteen longitudinal threads 1 to form a paper-supporting float for substantially one-half of the repeat on the paper side 4 and then extends along the same distance in the interior of the fabric substantially the other-half of the repeat while the other transverse thread 3*b* of this pair, interwoven at the same site, first extends in the fabric interior for substantially one-half of the repeat and only thereafter rises to the paper side 4 for a distance substantially the other half of the repeat. As is seen in FIG. 4, all the pattern diagonals are completely filled by the additional transverse threads 3.

The additional transverse threads in FIG. 1 and FIG. 3 are disposed in a vertical plane other than that containing the ordinary transverse threads 2 and 5 of the fabric. These figures show a section in the plane of the additional transverse threads 3 so that the visible cross sections of the longitudinal threads 1 are the same in this plane. The course of the ordinary transverse threads 2 and 5 visible in the background of FIG. 1 appear as though said transverse threads 2, 5 passed through said longitudinal threads 1. In fact, however, the longitudinal threads 1 at the crossing point with the ordinary transverse threads 2 and 5, have a different position than that in the illustrated cross section of the longitudinal wires 1 in FIG. 1. The additional transverse threads 3 are firmly interwoven in such a way that at least part of the longitudinal threads 1 lying above an additional transverse thread 3 then passes under one or both of the adjacent ordinary transverse threads 2.

The additional transverse threads 3 are preferably thinner than the ordinary transverse threads 2 of the upper layer. Since they are firmly interwoven with the longitudinal threads 1 and extend deep in the interior of the fabric over every second weave repeat of the basic fabric, the additional transverse threads 3 are preferably made of soft polyester or polyamide material. This offers the advantage of higher stability during cleaning of the papermachine fabric with high pressure water jets. Also, materials other than polyester or polyamide can be used for the additional transverse threads, e.g. polypropylene or polyvinylidene fluoride (Kynar). When special marking effects are to produced, floats of additional transverse theads of different diameters and different materials can be arranged along the weave diagonal D1 in order to interrupt the monotony of the thread imprint.

The following examples concern flat woven fabrics so that the longitudinal threads are equivalent to the warp and the transverse threads are equivalent to the weft.

EXAMPLE 1

A 14-harness fabric (seven-harness basic fabric) is produced with a warp course in which a warp extends over two weft pairs, between one weft pair, under one weft pair, and between three weft pairs, and the warp floats on the paper side have a seven-harness satin weave pattern, as shown in FIGS. 5 and 6.

Between each pair of ordinary weft threads 2, 5 an additional weft 3 is interwoven with the 14-harness weave shown in FIGS. 1 and 2.

The weave of the basic fabric is a basic seven-harness weave, and the additional weft threads 3 are not interwoven with the warp 1 in each seven-harness repeat, but extend within a seven-harness repeat on the paper side 4 and in the following seven-harness repeat in the fabric interior forming the 14 harness fabric pattern.

The lower weft threads 5 consist alternately of polyester and polyamide. On the paper side 4 the warp threads 1, the ordinary weft threads 2, and the additional weft threads are all disposed in one plane. On the running side, the ordinary weft 5 is disposed deeper than the warp by 8/100 mm, i.e. the papermachine fabric is a weft runner. Further information about the wires employed may be taken from the following table.

The fabric has a delicately structured surface on the paper side 4. It is used predominantly for the manufacture of writing and printing paper sensitive to marking. One might have expected that due to the irregularity of the structure in the direction of the right to left diagonal D2, this fabric would leave a more pronounced mark. However, surprisingly this was not so, presumably for the reason that the cumulation of weft floats along the left to right diagonal D1 is interrupted by missing weft floats. This is in contrast to the experience wherein the diagonal normally leaves the strongest mark.

EXAMPLE 2

The basic fabric is the same as in Example 1. The additional weft threads 2, however, are interwoven in pairs, as shown in FIGS. 3 and 4. The two additional weft threads 3*a* and 3*b* of each pair consist of different materials, as will be seen from the following table. The additional weft threads 3*a* and 3*b* are arranged to that along the weave diagonal D1 floats of polyester and polyamide alternate on the paper side 4.

| | Material (Monofilament) | Diameter (mm) | Density (number/cm) of Threads prior to/after setting | Elastic Modulus | Elongation at 27 cN/te |
|---|---|---|---|---|---|
| Examples 1 and 2 | | | | | |
| warp | polyester | 0.17 | 54/61 | high, longitudinally stable | |
| upper weft 2 | polyester | 0.20 | 19/17.5 | medium (Trevira 901) | 19% |
| lower weft 5 | polyester/ polyamide 6.6 | 0.22 | 19/17.5 | soft (Trevira 900) | 23.4% |
| Example 1 | | | | | |
| additional weft 3 | polyamide | 0.12 | 19/17.5 | soft | |
| Example 2 | | | | | |
| additional weft 3a | polyester | 0.10 | 19/17.5 | soft | |
| additional weft 3b | polyamide 6.6 | 0.10 | 19/17.5 | | |

While the invention has been particularly shown and described with reference to preferred embodiments thereof, it will be understood by those in the art that the foregoing and other changes in form and details may be made therein without departing from the spirit and scope of the invention.

What is claimed is:

1. A fabric for the sheet forming section of a papermaking machine comprising a double-layer fabric of conventional longitudinal and transverse threads interwoven in a repeating weave pattern, and additional transverse threads floating on the paper side, wherein said additional transverse threads have a repeat length twice the repeat length of the conventional transverse threads, and wherein the additional transverse threads alternately float in substantially the first half of the repeat length on the paper side and extend in the fabric interior for substantially the second half of the repeat length.

2. A fabric according to claim 1, wherein the additional transverse threads are interwoven in pairs with one of the additional transverse threads of each pair floating on the paper side while the other transverse thread of said pair extends in the fabric interior and wherein the course of the two additional transverse threads is exchanged after substantially half of the weave repeat of the additional transverse threads.

3. A fabric according to claim 1 wherein said additional transverse threads have a smaller diameter than the ordinary transverse threads on the paper side.

4. A fabric according to claim 1, wherein the additional transverse threads consist of a material having an elastic modulus not greater than the elastic modulus of the ordinary transverse threads on the paper side.

* * * * *